US009341007B2

(12) United States Patent
Liao

(10) Patent No.: US 9,341,007 B2
(45) Date of Patent: May 17, 2016

(54) STRUCTURE IMPROVEMENT OF ATTRACTION PLATE OF ELECTROMAGNETIC DOORLOCK

(71) Applicant: Yi-Fan Liao, Taoyuan County (TW)

(72) Inventor: Yi-Fan Liao, Taoyuan County (TW)

( * ) Notice: Subject to any disclaimer, the term of this patent is extended or adjusted under 35 U.S.C. 154(b) by 215 days.

(21) Appl. No.: 14/149,166

(22) Filed: Jan. 7, 2014

(65) Prior Publication Data

US 2014/0191517 A1 Jul. 10, 2014

(30) Foreign Application Priority Data

Jan. 9, 2013 (TW) ..... 102100753 A

(51) Int. Cl.
*H01F 1/00* (2006.01)
*E05C 19/16* (2006.01)

(52) U.S. Cl.
CPC ..... *E05C 19/166* (2013.01); *Y10T 292/11* (2015.04)

(58) Field of Classification Search
CPC ..... E05C 17/56; E05C 19/16; E05C 19/166; E05C 9/00; E05B 47/00; H01F 7/00
USPC ..... 335/296
See application file for complete search history.

(56) References Cited

U.S. PATENT DOCUMENTS 2,673,626 A * 3/1954 Bastin ..... A61B 6/0414 188/165
2,812,965 A * 11/1957 Horvay ..... E05C 19/16 292/251.5
4,487,439 A * 12/1984 McFadden ..... E05C 19/16 292/144
4,652,028 A * 3/1987 Logan ..... E05B 65/108 292/251.5
4,703,962 A * 11/1987 Kelly ..... E05B 65/108 292/251.5
4,716,393 A * 12/1987 Logie ..... H01F 7/1638 335/261
4,720,128 A * 1/1988 Logan, Jr. ..... E05C 19/166 292/251.5
4,840,411 A * 6/1989 Sowersby ..... E05C 19/168 292/144
4,957,316 A * 9/1990 Frolov ..... E05C 19/166 292/251.5
4,981,312 A * 1/1991 Frolov ..... E05C 19/168 248/27.1
5,016,929 A * 5/1991 Frolov ..... E05C 19/168 292/251.5

(Continued)

*Primary Examiner* — Shawki S Ismail
*Assistant Examiner* — Lisa Homza
(74) *Attorney, Agent, or Firm* — Rosenberg, Klein & Lee

(57) ABSTRACT

The main features of the structure improvement of attraction plate of electromagnetic doorlock, comprises a positioning assembly positioned on a mounted body at the position close to both ends of the attraction plate, an attraction surface having a recessed portion below the horizontal plane of 0.06 mm to 0.26 mm at a central region thereof, and the recessed portion extending towards both ends to form an arc surface, so that a concave-arc surface is formed with both ends lower than the central region. The present invention uses the concave arc design of the attraction surface to maintain the normal current of the electric magnet while the attraction plate is pulled by the curved internal stress structure for saving energy and enhancing the security access control.

7 Claims, 15 Drawing Sheets

(56) References Cited

U.S. PATENT DOCUMENTS 5,184,856 A * 2/1993 Waltz ..... E05C 19/168 292/144
5,376,910 A * 12/1994 Geringer ..... E05C 19/166 292/251.5
5,611,582 A * 3/1997 Frolov ..... E05C 19/166 292/251.5
5,641,187 A * 6/1997 Frolov ..... E05C 19/166 292/251.5
5,897,149 A * 4/1999 Frolov ..... E05C 19/166 292/144
6,007,119 A * 12/1999 Roth ..... E05C 19/166 292/251.5
6,053,546 A * 4/2000 Frolov ..... E05C 19/166 292/144
6,260,892 B1 * 7/2001 Chang ..... E05C 19/166 292/251.5
6,609,738 B1 * 8/2003 Roth ..... E05B 65/108 292/144
6,611,414 B1 * 8/2003 Lavelle ..... E05C 19/168 361/154
6,722,715 B1 * 4/2004 Chiang ..... E05C 19/168 292/251.5
6,857,671 B2 * 2/2005 Fly ..... E05B 17/2084 292/251.5
8,585,105 B1 * 11/2013 Dobbins, Sr. ..... E05B 65/08 292/251.5
8,757,685 B2 * 6/2014 Chang ..... E05C 17/56 292/251.5
2004/0026933 A1 * 2/2004 Smith ..... E05C 19/166 292/251.5

* cited by examiner

STRUCTURE IMPROVEMENT OF ATTRACTION PLATE OF ELECTROMAGNETIC DOORLOCK

BACKGROUND OF THE INVENTION

1. Field of the Invention

The invention relates to a structure improvement of attraction plate of electromagnetic doorlock, particularly to an attraction surface of an attraction plate as a concave-arc surface structure, forming a curved internal stress.

2. Description of the Related Art

In the access control monitoring system, the use of an electromagnetic doorlock has been very popular. The electromagnetic doorlock 10 as shown in FIG. 1 provides an electric magnet 11 mounted on a door flame 15 and an attraction plate 12 mounted on a corresponding position of a door plate 14. When the electric magnet 11 is energized to produce electromagnetic attraction and attract the attraction plate 12, the electromagnetic doorlock 10 forms in a lock state. When the electric magnet 11 is de-energized and the attraction plate 12 detaches from the electric magnet 11, the electromagnetic door lock 10 then forms in an unlock state.

The traditional attraction plate 12 as FIGS. 2 to 4 comprises an attraction surface 121 in a flat shape, and one or two positioning holes 122. The attraction plate 12 is fixed on a mounted body 13 by a screw 123 and other related accessories 124. The mounted body 13 as shown in FIG. 2 is in a box shape. With the reference to FIG. 1A, the mounted body 13 has a plurality of fixed holes 125 for fixed to the door plate 14 by a plurality screws 126, but it is not a limitation. basically, the mounted body 13 can be set for any shapes or the door plate 14 directly can be as a mounted body 13 to fix the attraction plate 12 by the screw 123 and other related accessories 124 as shown in FIG. 1B. No matter what shape of the mounted body 13 is, the combination method of the mounted body 13 and attraction plate 12 is the same, and the attraction surface 121 is a plat surface. For example, the U.S. Pat. No. 4,487,439 discloses a screw and a positioning hole, and the U.S. Pat. No. 4,652,028 discloses tow screws and two positioning holes.

This kind of structure of the attraction surface 121 is used for many years. After continuous research, the inventor found out that after the electric magnet 11 is energized, the magnetic flux density (B) is strong in the region of both ends, and the magnetic flux density (B) is weak in the middle region. Thus, as shown in FIGS. 4 and 5A, 5B, when the door plate 144 is pulled, the action force (F) is focus on the screw 123 in the middle, and the electric plate 12 is pulled by the screw 123. At this time, the middle region of the electric plate 12 is curved and deformed like a dotted line (C) as shown in FIG. 5B, and the curvature and deformation will affect the attraction effect at both sides of the electric plate 12. That is, when the region of the electric plate 12 is curved and deformed, the attraction surface 121 will departed from the electric magnet 11. The experimental result shows that when the electric magnet is subjected to 500 mA current and 12V voltage, the electric magnet with strength of 185 mm and thickness of 15 mm is easily to be pulled away from the attraction plate as the tension value is between 400 to 500 pounds. The industry claimed that the tension value can reach to 600 pounds, but the attraction plate is pulled with less than 500 pounds. Therefore, to increase the attraction force of the attraction plate 12 of the conventional electromagnetic doorlock, the current of the electric magnet 11 or the attraction area of the electric magnet and attraction plate should be increased, forming a waste of energy or increasing the materials and transportation costs. Accordingly, there is room for improvement of the structure of conventional attraction plate 12.

SUMMARY OF THE INVENTION

It is the main object of the present invention to provide a structure improvement of attraction plate so that under the unchanged current of the electric magnet or unchanged attraction area between the electric magnet and attraction plate, the tension value is increased more than 10% to save energy and enhance the security access control.

In order to achieve the above objects, the structure improvement of attraction plate of electromagnetic doorlock, comprises an electric magnet; an attraction plate, having an attraction surface, the attraction surface arranged at a corresponding surface of the electric magnet, and the attraction plate positioned on a mounted body, wherein a positioning assembly is positioned on the mounted body at the position close to both ends of the attraction plate, the attraction surface has a recessed portion below the horizontal plane of 0.06 mm to 0.26 mm at a central region thereof, and the recessed portion extends towards both ends to form an arc surface, so that a concave-arc surface is formed with both ends lower than the central region; whereby when the attraction plate is attracted by the magnetic force produced by the electric magnet, the concave-arc surface is forced to deform for abutting the electric magnet; when the mounted body is pulled in an opposite direction of the electric magnet, both ends of the attraction plate under the tension of a positioning assembly is corresponding to both ends of the electric magnet to enhance the tensile value of the attraction plate.

Base on the features disclosed, the present invention uses the concave arc design of the attraction surface to maintain the normal current of the electric magnet while the attraction plate is pulled by the curved internal stress structure for saving energy and enhancing the security access control.

DETAILED DESCRIPTION OF THE PREFERRED EMBODIMENT

Figure 12:
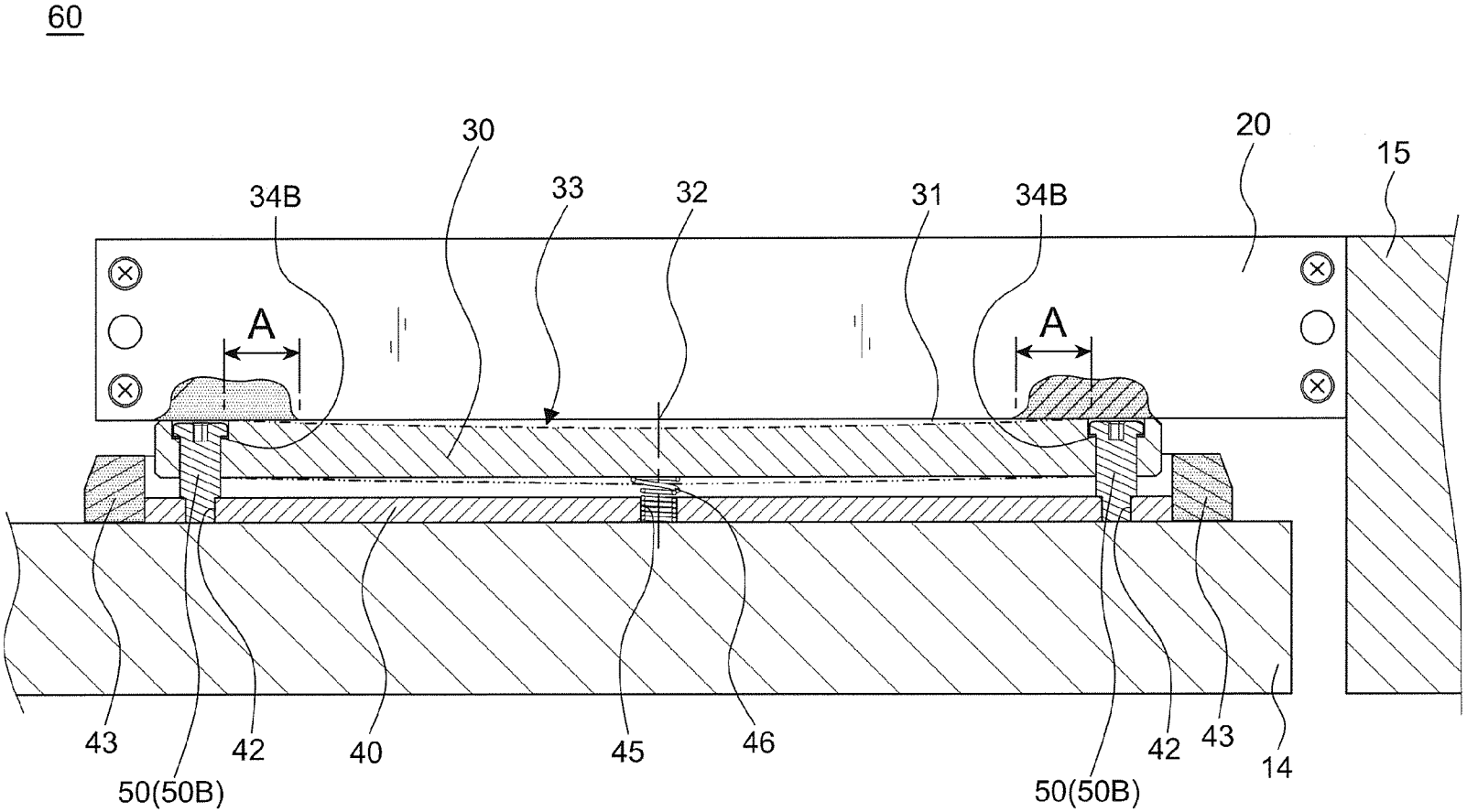
FIG. 12 is an exploded view of the preferred embodiment in accordance with the present invention, showing the attraction state of the attraction plate and electric magnet.

With the referenced to FIGS. 6 through 14B, an electromagnetic doorlock 60 of the preferred embodiment in accordance with the present invention comprises an electric magnet 20, and an attraction plate 30 having an attraction surface 31. The attraction surface 31 is arranged at a corresponding surface of the electric magnet 20, and the attraction plate 30 is positioned on a mounted body 40. FIG. 12 is a sectional view of the attraction status of the electric magnet 20 and attraction plate 30 in accordance with the present invention; wherein the electric magnet 20 is fixed to a door flame 15, and the attraction plate 30 is mounted on the mounted body 40 which is fixed to a door plate 14. The electromagnetic doorlock 60 in the embodiment basically has the same mounted method with an electromagnetic door lock 10 of prior art, and thus will not be described in details here. Also, the electric magnet 20 is not the main feature of the present invention and thus will not be described in details here. Besides, the mounted body 40 disclosed in the present invention not limited to the following shapes can be any shapes as required, or the door plate 14 directly as the mounted body 40 is provided for positioning the attraction plate 30.

The structure of the attraction plate 30 is the main feature of the present invention. With the reference to FIGS. 12 to 14B, the present invention has two important features: the actuation position of the tensile force F of the attraction plate 30, and the attraction surface 31 is a concave-arc surface 33.

Figure 13:
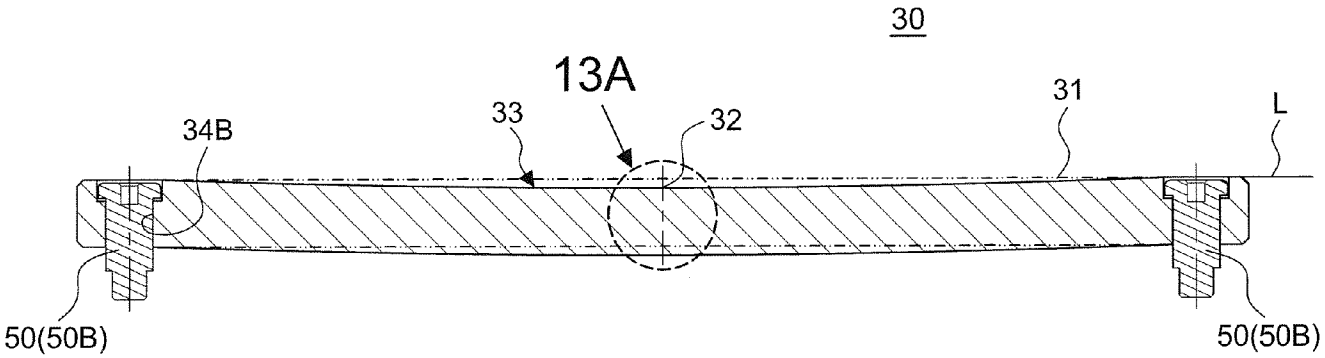
FIG. 13 is an exploded view of the attraction plate structure in accordance with the present invention.
Figure 13A:
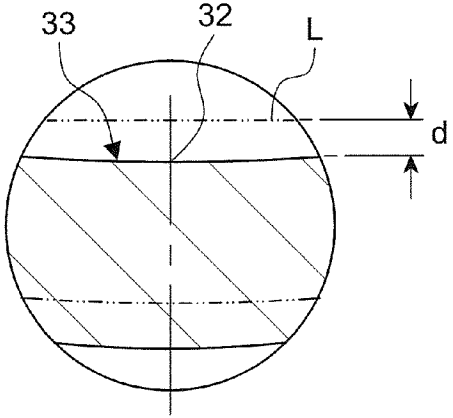
FIG. 13A is a partially enlargement view of FIG. 13.

With the reference to FIGS. 13 and 13A, the concave-arc surface 33 below the horizontal plane L has a depth d, and the depth d being a relative low point at a recessed portion 32 extends towards of both ends to form an arc surface. The horizontal plane L here refers to a virtual straight line, a line for pulling from the highest position of both ends of the attraction plate 30. The forming of the concave-arc surface 33 includes bending, shaping, punching, planing and milling, and other processing methods for the attraction plate 30 to have a curved internal stress. Whereby when the attraction plate 30 is contacted to the electric magnet 20, the attraction plate 30 with the curved internal stress is attracted by the magnetic force and forced to deform rapidly for abutting the electric magnet 20 for the strong magnetic force of the electric magnet 20 as shown in FIG. 12.

Figure 1:
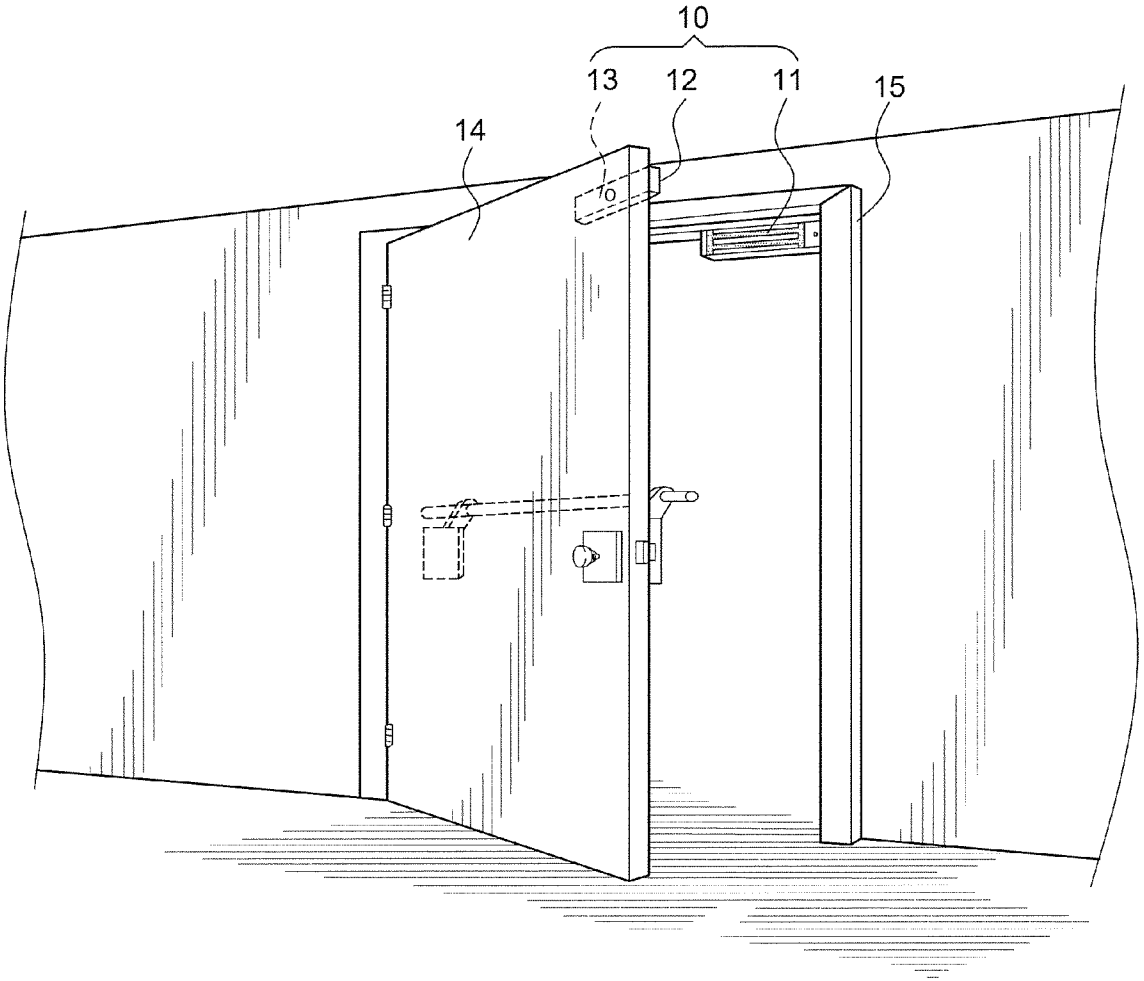
FIG.1 PRIOR ART
FIG. 1 is a schematic view of a conventional electromagnetic doorlock.
Figure 1B:
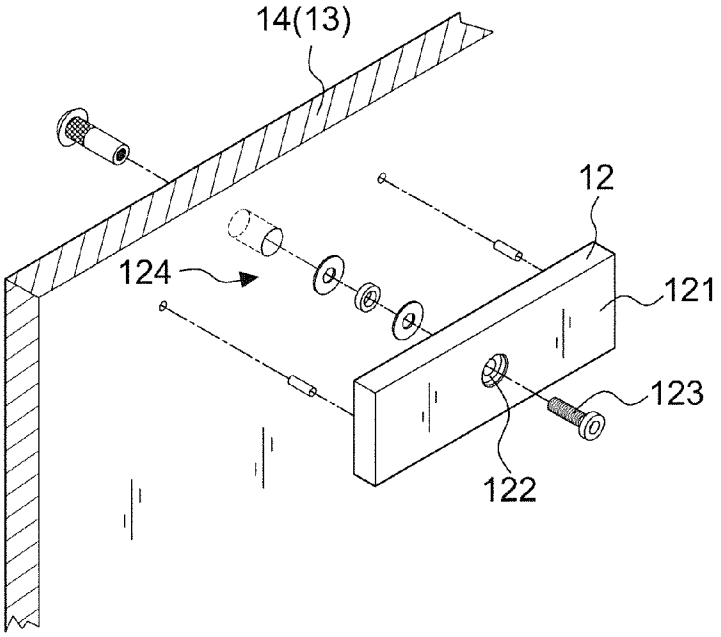
FIG.1B PRIOR ART
FIG. 1B is another exploded perspective view of the mounted body of the conventional electromagnetic doorlock.
Figure 1A:
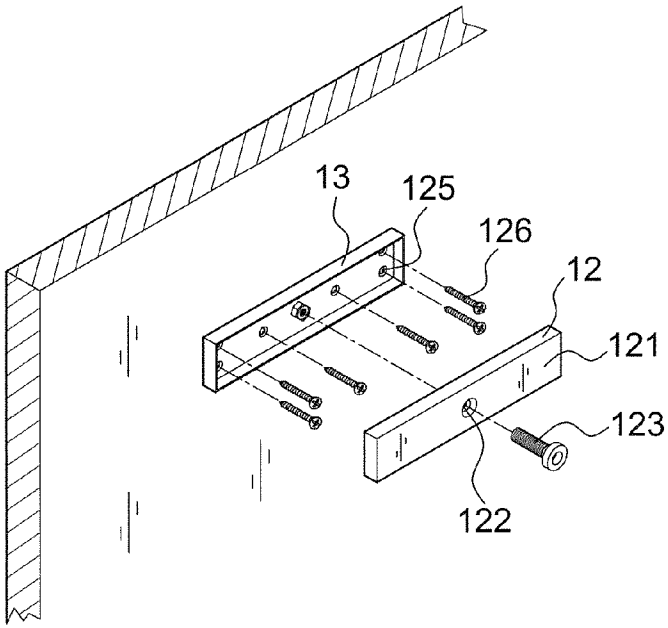
FIG.1A PRIOR ART
FIG. 1A is an exploded perspective view of the mounted body of the conventional electromagnetic doorlock.
Figure 2:
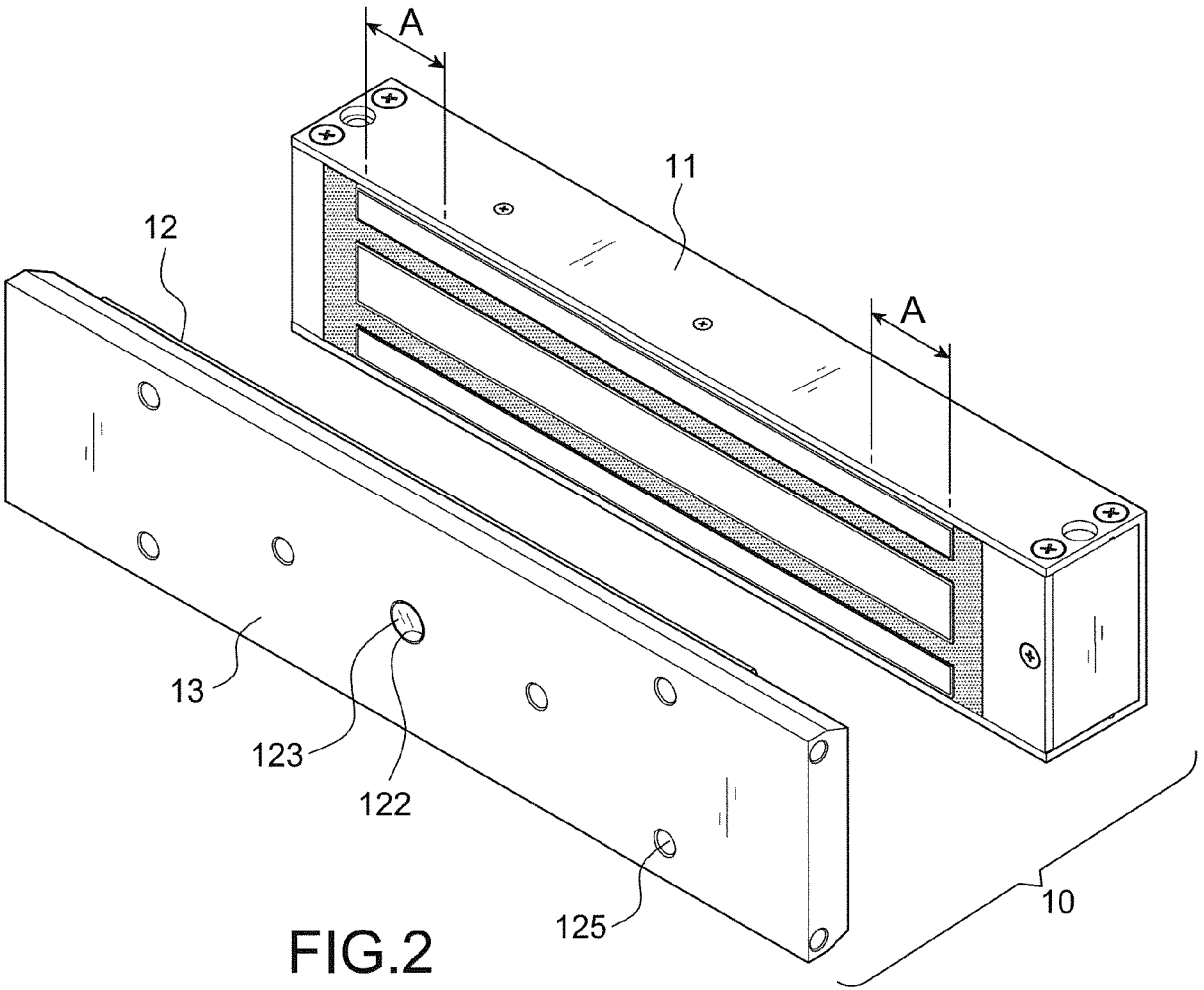
FIG.2 PRIOR ART
FIG. 2 is a perspective view of the separation of the conventional electromagnetic doorlock.
Figure 3:
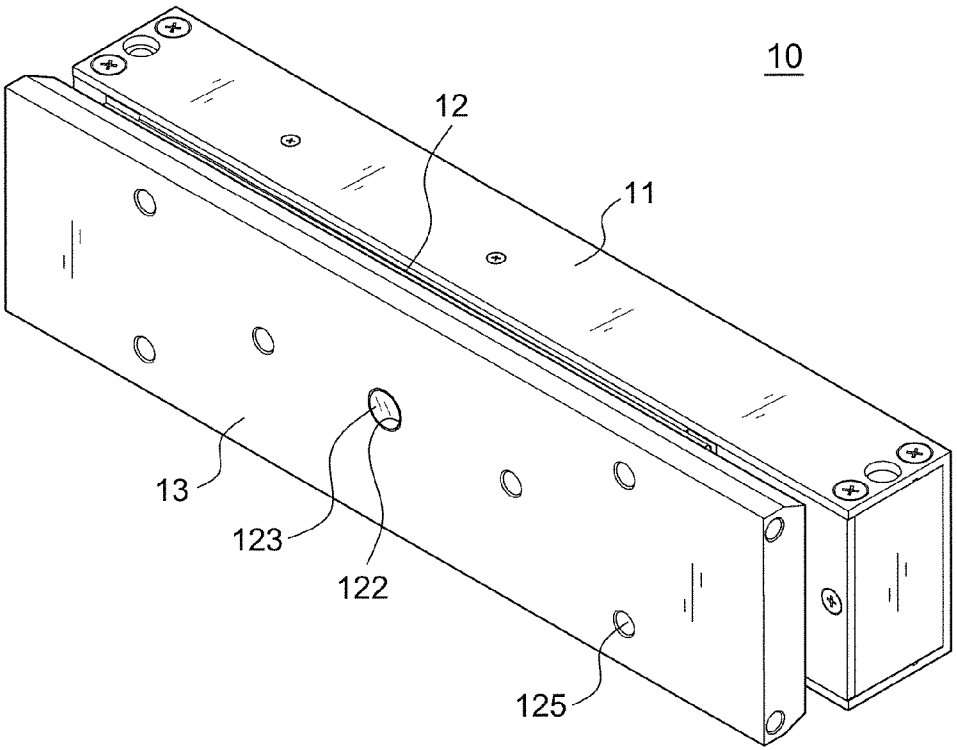
FIG.3 PRIOR ART
FIG. 3 is a perspective view of the attraction state of the conventional electromagnetic doorlock.
Figure 4:
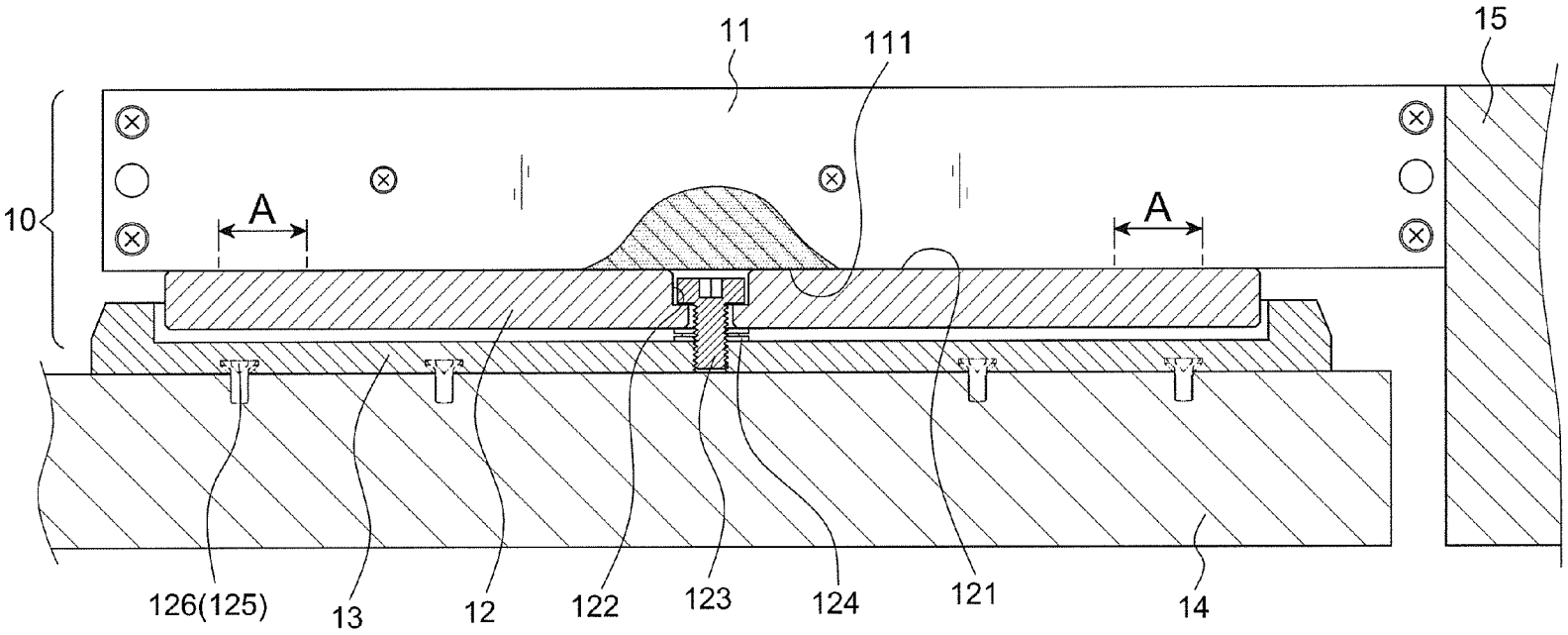
FIG.4 PRIOR ART
FIG. 4 is an exploded view of the attraction state of the conventional electromagnetic doorlock.
Figure 5A:
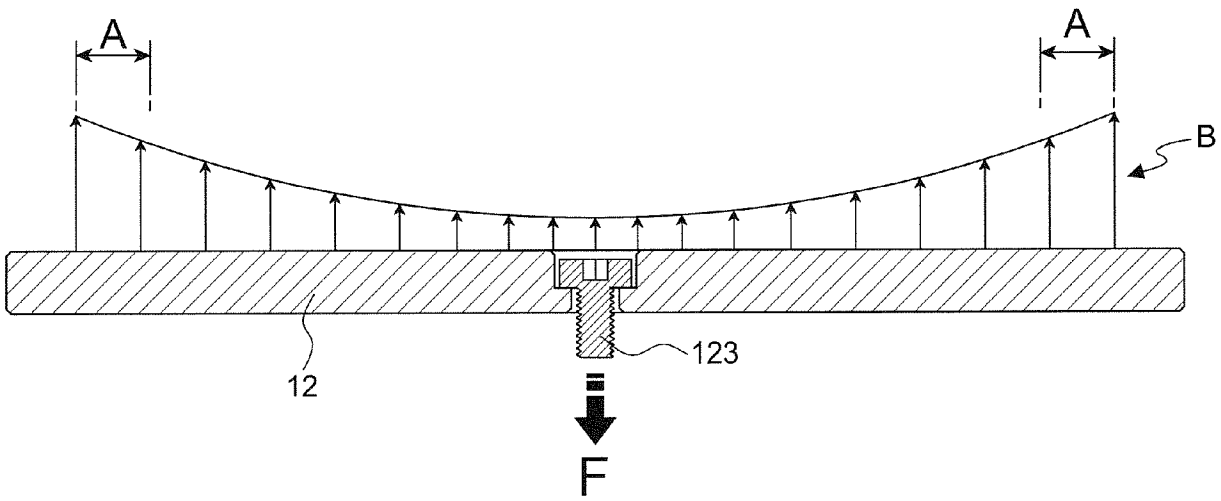
FIG.5A PRIOR ART
FIG. 5A is a distribution diagram of an attraction force of an attraction plate of the conventional electromagnetic doorlock.
Figure 5B:
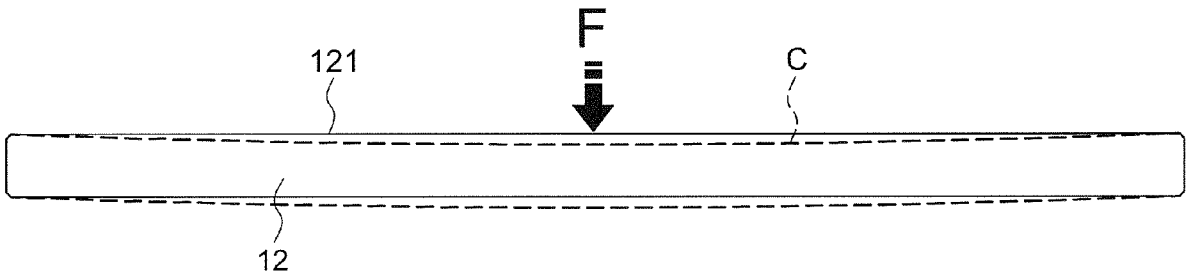
FIG.5B PRIOR ART
FIG. 5B is a deformation diagram of a tensile force of an attraction plate of the conventional electromagnetic doorlock.
Figure 14A:
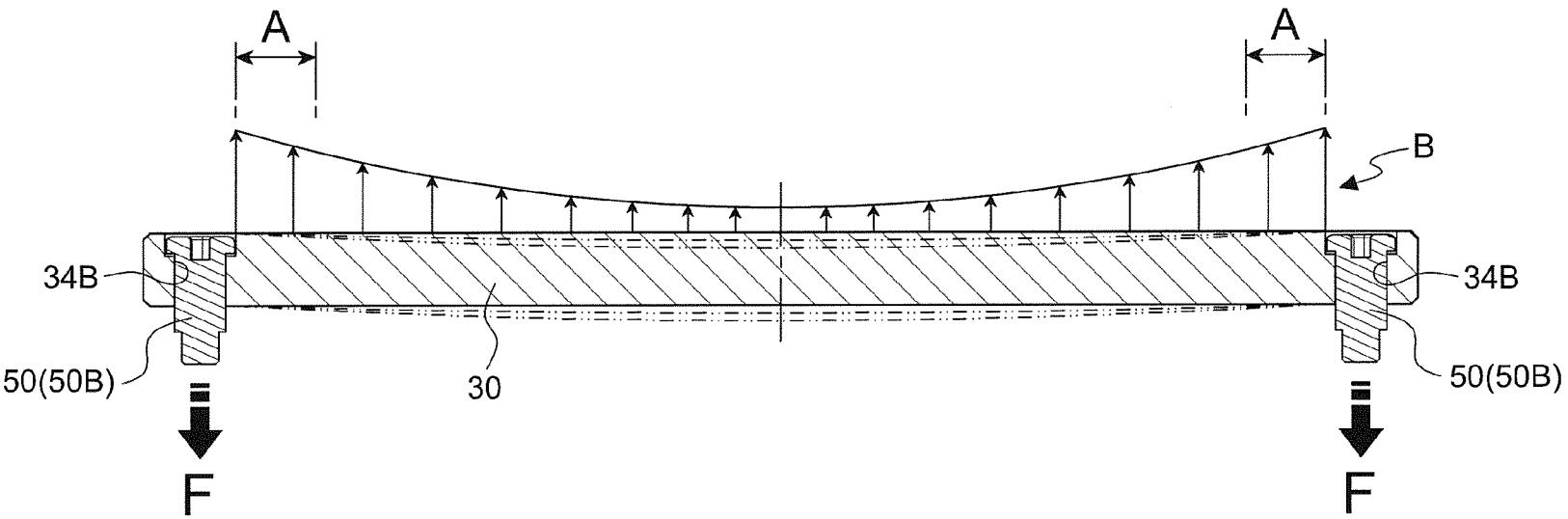
FIG. 14A is a distribution diagram of an attraction force of the attraction plate in accordance with the present invention.
Figure 14B:
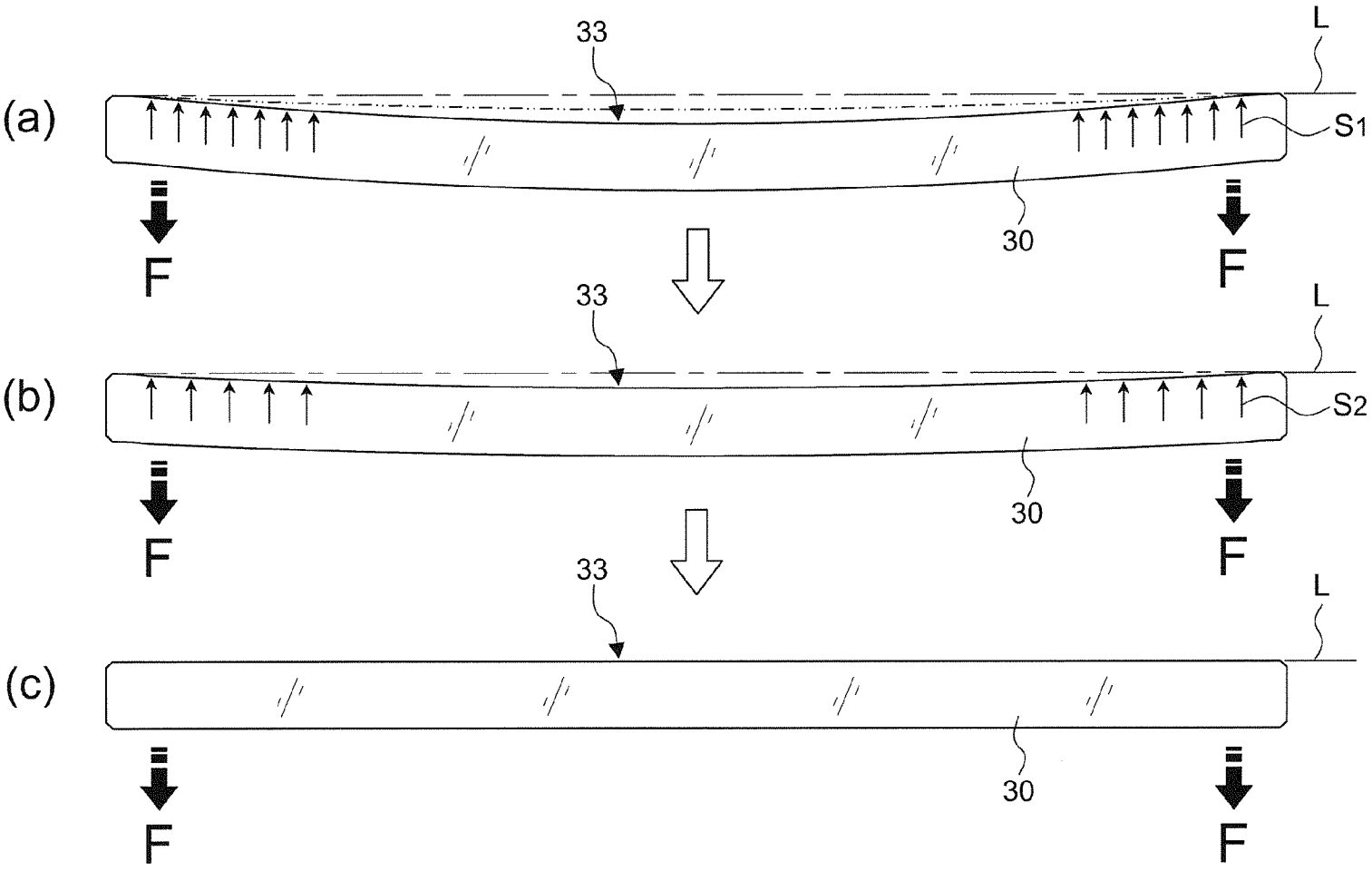
FIG. 14B is a deformation diagram of a tensile force of the attraction plate in accordance with the present invention.

Comparing FIGS. 14A and 14B with FIGS. 5A and 5B, a positioning assembly 50 of the present invention is arranged at both ends of the attraction plate 30, and there is no positioning member between both ends, namely the tensile force F of the present invention is provided at an area A having stronger magnetic flux density B. Unlike the prior art, the tensile force F is provided in the middle area with weak magnetic flux density B. However, there is no effect to change the position of the tensile force only; therefore, the inventor further experiments to set the attraction surface 31 of the attraction plate 30 into the concave-arc surface 33. FIG. 14B is a schematic view, showing the change of the concave-arc surface 33 by enlarging the deformation curve to indicate that the tensile force is increased by the stress by curved internal stress. The experiment proved the depth d of the concave-arc surface 33 between 0.06 mm~0.26 mm can play a larger effect. If the depth of the concave-arc surface 33 is too deep, the curved internal stress will be too large to offset the attraction force of the electric magnet 20, decreasing the tensile force. From the material mechanics point of view, the attraction plate 30 is slightly like a "⌣"-shaped beam, and both ends are positions with stronger magnetic force; thus, when the attraction plate 30 is pulled away from the electric magnet 20, the present invention not only overcomes the magnetic force of the electric magnet 20 but overcomes the curved internal stress produced at both ends of the "⌣"-shaped attraction plate 30. The curved internal stress as shown in FIG. 14B gradually changes in sequence from figure (a), (b) to (c). The figure (a) shows strong curved internal stress S1 at both ends of the attraction plate 30, and then the strong curved internal stress S1 gradually becomes weak curved internal stress S2 as shown in figure (b) for the tensile force F is increased. Finally, the tensile force F continually increases to the state shown in the figure (c), so that the attraction plate 30 can be pulled away from the electric magnet 20. Both structures of tensile force F at both ends, and the concave-arc surface 33 in the middle are indispensable, having a complementary effect. Accordingly, in the case of the constant input current of the electric magnet 20, the electromagnetic doorlock 60 of the present invention can increase the tension value by more than 10%.

In principle, as long as the positioning assembly 50 is able to pull both ends of the attraction plate 30, the type of the positioning assembly 50 is not a limitation. The mounted body 40 includes a box-like body, U-shaped body, L-shaped body, or flat body. The above components can also be embedded in the door, or the door is directly as the mounted body 40. An applicable embodiment as shown in FIGS. 6 to 12 is described below.

Figure 6:
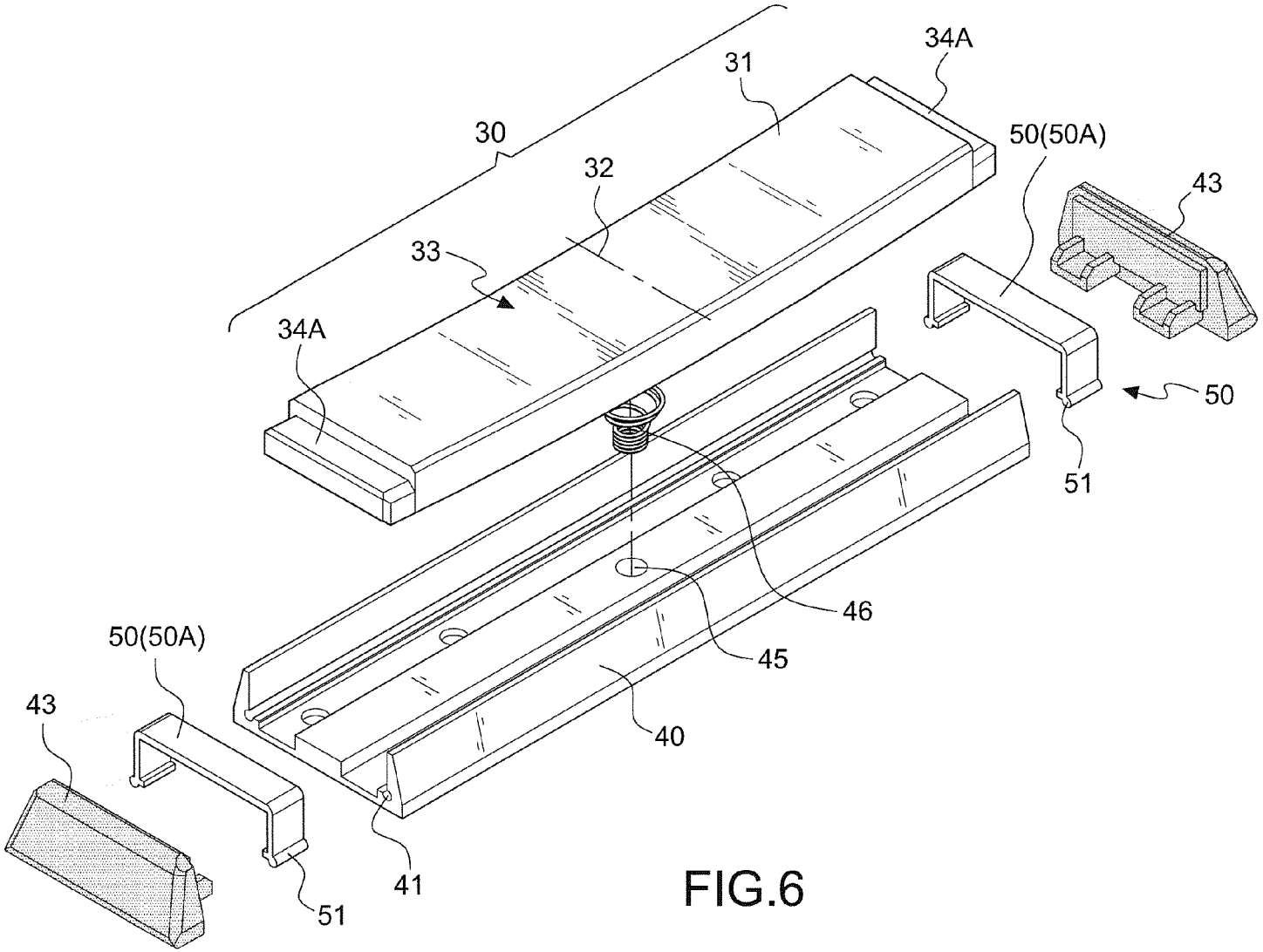
FIG. 6 is an exploded perspective view of an attraction plate of the first embodiment in accordance with the present invention.
Figure 7:
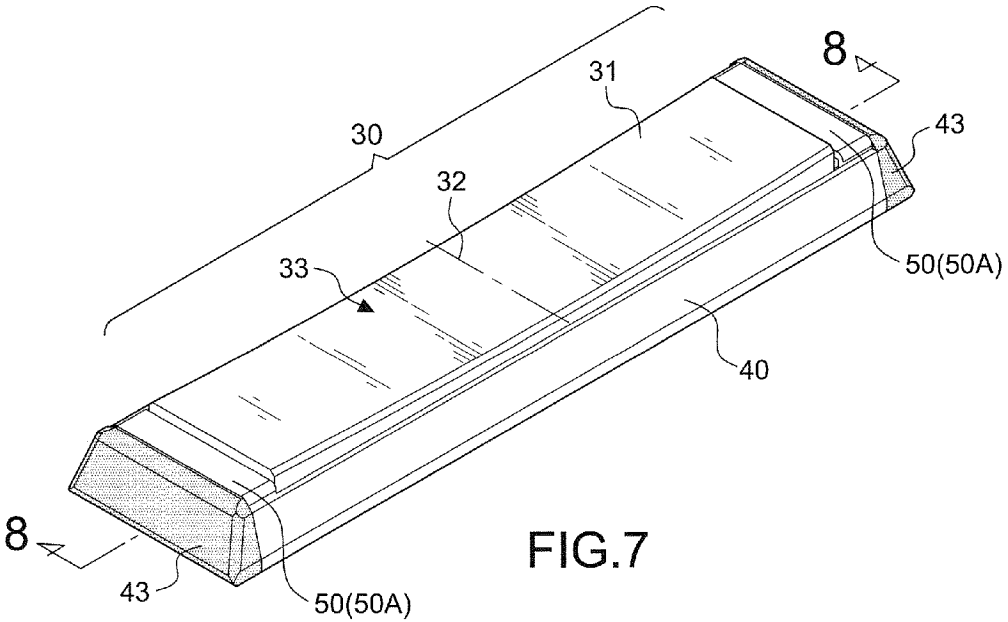
FIG. 7 is an assembly perspective view of the attraction plate of the first embodiment in accordance with the present invention.
Figure 8:
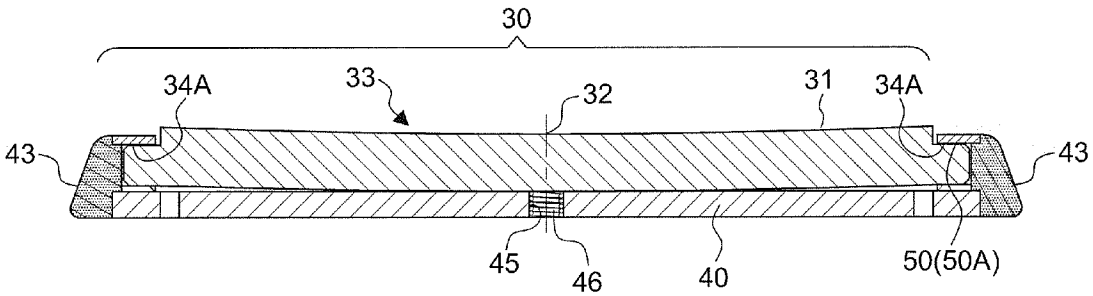
FIG. 8 is an assembly exploded view of the attraction plate of the first embodiment in accordance with the present invention.
Figure 9:
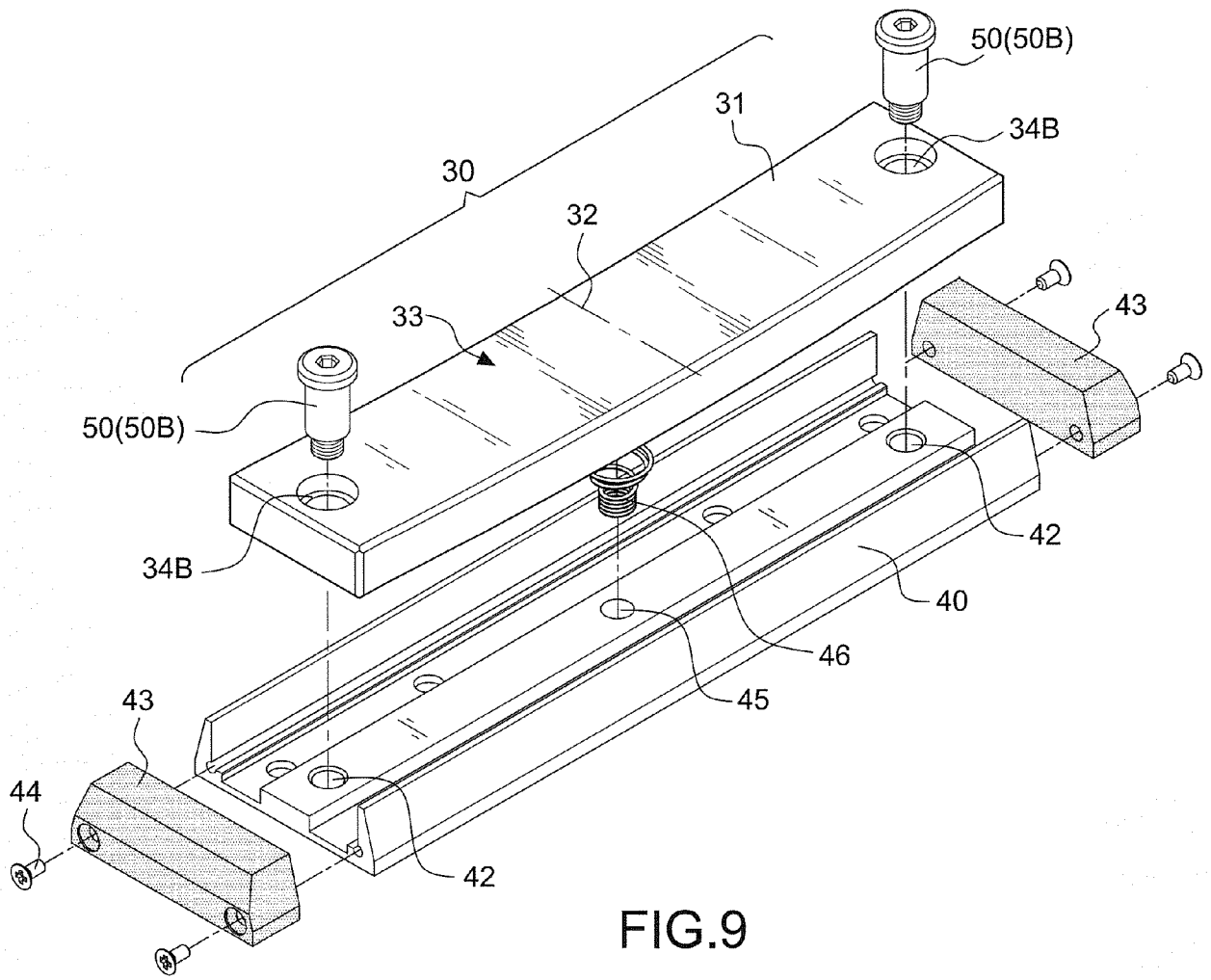
FIG. 9 is an exploded perspective view of an attraction plate of the second embodiment in accordance with the present invention.
Figure 10:
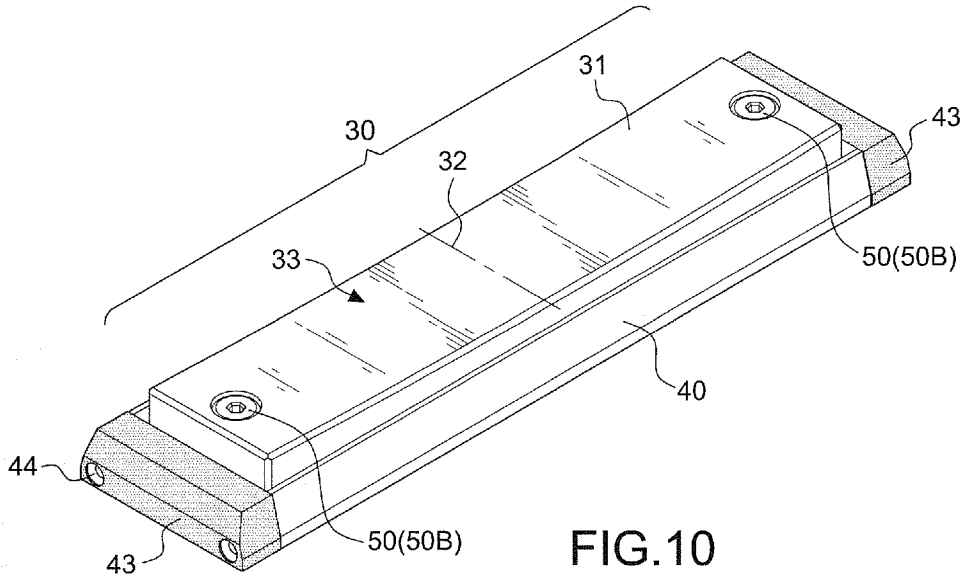
FIG. 10 is an assembly perspective view of the attraction plate of the second embodiment in accordance with the present invention.
Figure 11:
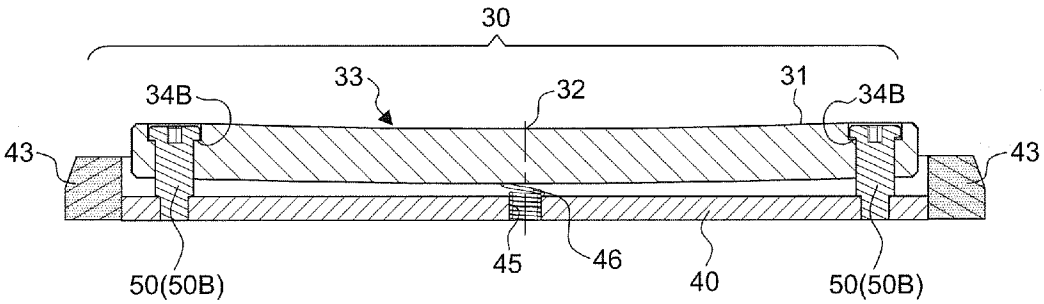
FIG. 11 is an assembly exploded view of the attraction plate of the second embodiment in accordance with the present invention.

With the reference to FIGS. 6 to 8, the mounted body 40 being a box-like body has a vertical insertion groove 41 at both inner side edges; the positioning assembly 50 being a U-shaped engaging member 50A has a flange 51 at a bottom surface of both ends for inserting into the insertion groove 41; the attraction plate 30 has a positioned surface 34A formed at both ends thereof for engaging with the engaging member 50A to fix the attraction plate 30 to the mounted body 40; the mounted body 40 further has side covers 43 at both ends. The mounted body 40 further has a recessed hole 45 in the middle thereof, and a spring 46 arranged between the recessed hole 45 and a bottom surface of the attraction plate 30.

In another embodiment as shown in FIGS. 9 to 12, the mounted body 40 being a box-like body has a positioning hole 34B at a both front and rear sides; the positioning assembly 50 is a countersunk bolt 50B engaging into the positioning hole 34B to fix the attraction plate 30 to the mounted body 40. The mounted body 40 further has side covers 43 at both ends, and the side covers 43 fixed by a screw 44. The mounted body 40 further has a recessed hole 45 in the middle thereof, and a spring 46 arranged between the recessed hole 45 and a bottom surface of the attraction plate 30.

To test and verify the effectiveness of the present invention, the inventor uses the attraction plate of 185 mm×38 mm×15 mm to conduct the tensile test. The following table shows the attraction plate after being energized of 500 mA current, and 12V voltage.

| No. | Attraction surface | Tensile position of attraction plate | Tensile value (pound) | Increased rate of tensile value |
|---|---|---|---|---|
| 1 | NO concave-arc surface | Middle | About 502 | — |
| 2 | NO concave-arc surface | Both ends | About 400 | ↓ |
| 3 | concave-arc surface (d): 0.02 mm | Both ends | About 440 | ↓ |
| 4 | concave-arc surface (d): 0.04 mm | Both ends | About 490 | ↓ |
| 5 | concave-arc surface (d): 0.06 mm | Both ends | About 556 | 10.76% ↑ |
| 6 | concave-arc surface (d): 0.09 mm | Both ends | About 625 | 24.50% ↑ |
| 7 | concave-arc surface (d): 0.12 mm | Both ends | About 682 | 35.86% ↑ |
| 8 | concave-arc surface (d): 0.15 mm | Both ends | About 730 | 45.42% ↑ |
| 9 | concave-arc surface (d): 0.18 mm | Both ends | About 750 | 49.40% ↑ |
| 10 | concave-arc surface (d): 0.21 mm | Both ends | About 680 | 35.46% ↑ |
| 11 | concave-arc surface (d): 0.23 mm | Both ends | About 590 | 17.53% ↑ |
| 12 | concave-arc surface (d): 0.26 mm | Both ends | About 555 | 10.56% ↑ |
| 13 | concave-arc surface (d): 0.28 mm | Both ends | About 500 | — |

Figure 15:
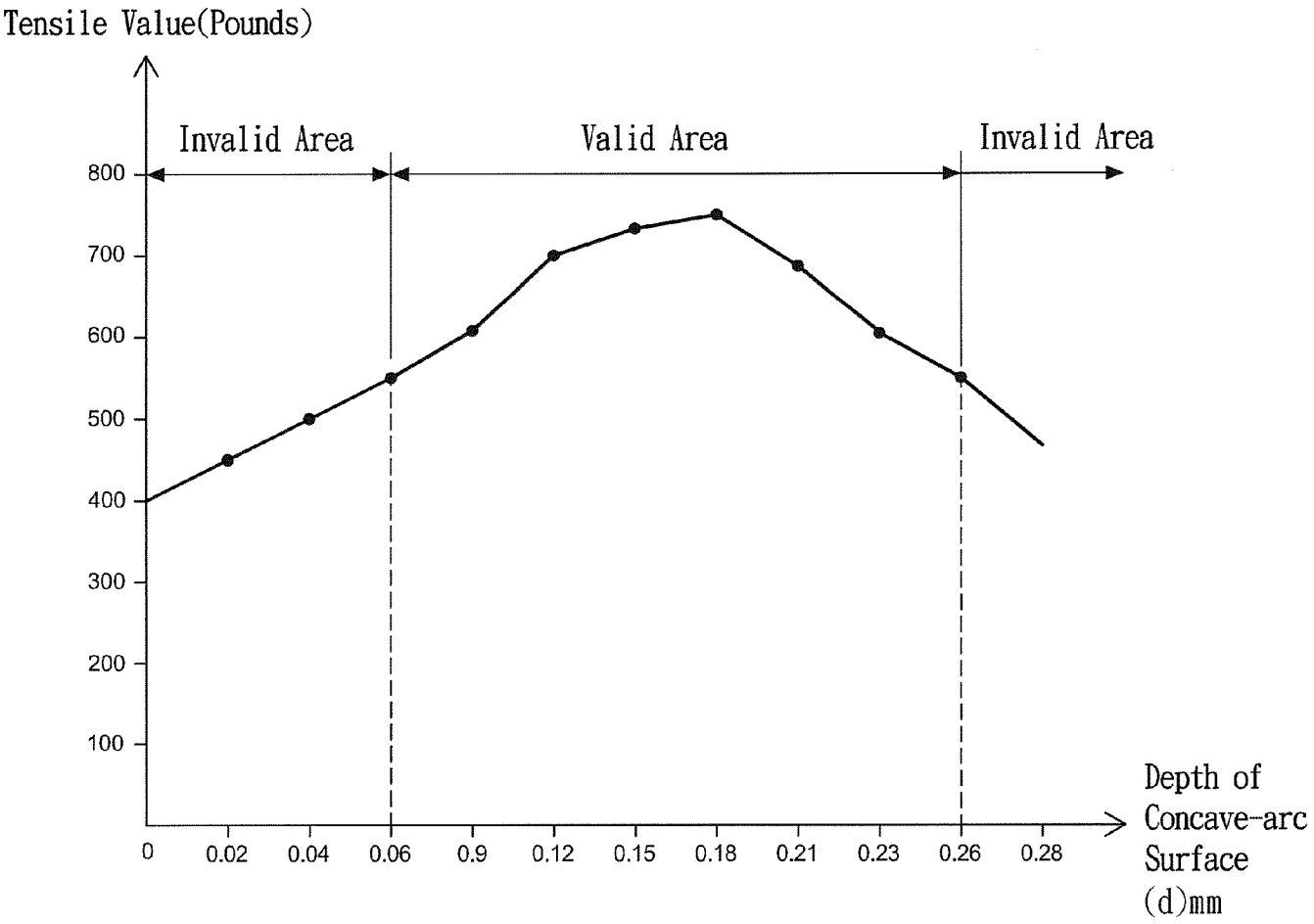
FIG. 15 is a curved diagram of the tensile test of the present invention.

From the above test values, if the tensile position of attraction plate is in the middle without the arc surface in the middle, the tensile value is about 502 pounds. If the tensile position of attraction plate is at both ends without the arc surface in the middle, the tensile value is declined to 400 pounds. If the tensile position of attraction plate is at both ends with the concave-arc surface, there is no effect while the depth d of the concave-arc surface is within 0.06 mm; however, the tensile value is significantly increased between 0.06 mm to 0.26 mm. FIG. 15 is a curve diagram drew according to the present test, showing that the depth d of the concave-arc surface between 0.12 mm to 0.21 mm has the best tensile value. When the depth is over 0.26 mm, the curved internal stress will be too large to offset the attraction force of the electric magnet 20, decreasing the tensile force and forming an invalid area. Therefore, The above test value uses the attraction plate of 185 mm×38 mm×15 mm; however, normal size of the attraction plate mostly has length from 180 to 200 mm, and thickness from 11 to 16 mm. Therefore, different attraction plate has different tensile value after test, but the corresponding increased rate of tensile value and the curve tendency diagram basically has little different. Thus, the tensile force at both ends, and the concave-arc surface 33 in the middle are indispensable, having a complementary effect. Under the same current, the tensile value of the electromagnetic doorlock is increased at least 10% to save energy and enhance the security access control.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A structure improvement of attraction plate of electromagnetic doorlock, comprising:

an electric magnet;

an attraction plate, having an attraction surface, the attraction surface arranged at a corresponding surface of the electric magnet, and the attraction plate positioned on a mounted body; and;

a positioning assembly positioned on the mounted body at a position close to opposing ends of the attraction plate, the attraction surface has a recessed portion below a horizontal plane of 0.06 mm to 0.26 mm at a central region thereof, and the recessed portion extends towards both ends to form an arc surface defining a bowed surface forming an arcuate recess between the attraction plate and the electric magnet, so that a concave-arc surface is formed with both ends above the central region;

the attraction plate being devoid of any positioning member at a location between the opposing ends of the attraction plate, whereby when the attraction plate is attracted by the magnetic force produced by the electric magnet, the concave-arc surface is forced to deform for abutting the electric magnet; when the mounted body is pulled in an opposite direction of the electric magnet, both ends of the attraction plate under the tension of a positioning assembly is corresponding to both ends of the electric magnet to enhance the tensile value of the attraction plate.

2. The structure improvement of attraction plate of electromagnetic doorlock as claimed in claim 1, wherein the mounted body includes a box-like body, U-shaped body, L-shaped body, flat body, or door plate.

3. The structure improvement of attraction plate of electromagnetic doorlock as claimed in claim 2, wherein the mounted body being a box-like body has a vertical insertion groove at both inner side edges; the positioning assembly being a U-shaped engaging member has a flange at a bottom surface of both ends for inserting into the insertion groove; the attraction plate has a positioned surface formed at both ends thereof for engaging with the engaging member to fix the attraction plate to the mounted body; the mounted body further has side covers at both ends.

4. The structure improvement of attraction plate of electromagnetic doorlock as claimed in claim 3, wherein the mounted body further has a recessed hole in the middle thereof, and a spring arranged between the recessed hole and a bottom surface of the attraction plate.

5. The structure improvement of attraction plate of electromagnetic doorlock as claimed in claim 2, wherein the mounted body being a box-like body has a positioning hole at a both front and rear sides; the positioning assembly is a countersunk bolt engaging into the positioning hole to fix the attraction plate to the mounted body.

6. The structure improvement of attraction plate of electromagnetic doorlock as claimed in claim 5, wherein the mounted body further has side covers at both ends, and the side covers fixed by a screw.

7. The structure improvement of attraction plate of electromagnetic doorlock as claimed in claim 6, wherein the mounted body further has a recessed hole in the middle thereof, and a spring arranged between the recessed hole and a bottom surface of the attraction plate.

* * * * *